United States Patent [19]

Jullien et al.

[11] Patent Number: 4,820,206

[45] Date of Patent: Apr. 11, 1989

[54] SCREW CONNECTION DEVICE FOR ELECTRIC CONDUCTORS

[75] Inventors: Claude Jullien, Mouans Sartoux; Gérard Lerude, Antibes; Raymond Llabres, Saint Laurent Du Var, all of France

[73] Assignee: La Telemecanique Electrique, France

[21] Appl. No.: 164,362

[22] Filed: Mar. 4, 1988

[30] Foreign Application Priority Data

Mar. 5, 1987 [FR] France ..... 87 03275

[51] Int. Cl.[4] ..... H01R 4/44

[52] U.S. Cl. ..... 439/782; 439/781; 439/814; 439/810

[58] Field of Search ..... 439/709, 718, 781, 782, 439/790, 810, 814

[56] References Cited

U.S. PATENT DOCUMENTS

| | | | |
|---|---|---|---|
| 3,470,526 | 9/1969 | Joly | 439/781 |
| 4,531,797 | 7/1985 | Jullien et al. | 439/592 |
| 4,547,627 | 10/1985 | McGrane | 439/810 |
| 4,611,876 | 9/1986 | Barrabe's | 439/782 |

FOREIGN PATENT DOCUMENTS

| | | | |
|---|---|---|---|
| 2335932 | 1/1975 | Fed. Rep. of Germany | 439/782 |
| 2448111 | 4/1976 | Fed. Rep. of Germany | 439/782 |
| 0657232 | 8/1986 | Switzerland | 439/814 |

*Primary Examiner*—Paula A. Austin Bradley
*Attorney, Agent, or Firm*—William A. Drucker

[57] ABSTRACT

A screw connection device for electric conductors, is provided having at least one screw-clamping piece assembly. A structure integral with the insulating body of the terminal, partially surrounds the screw head and has at least one heel. This heel is applicable against an inclined face of the clamp and is adapted so as to hold the screw-clamp assembly in position against removal along the axis of the screw and against tipping towards the conductor insertion side.

4 Claims, 1 Drawing Sheet

SCREW CONNECTION DEVICE FOR ELECTRIC CONDUCTORS

BACKGROUND OF THE INVENTION

1. Field of the Invention

The present invention relates to a screw connection device for electric conductors, having at least one terminal with a clamping screw which may be screwed into a tapped orifice of a contact piece, a clamping piece mounted so as not to be lost under the screw head, an insulating body with an excess opening for a tool for actuating the screw head and a housing for the screw-clamp assembly, the walls of this housing cooperating with the clamping piece so as to permit a translational movement thereof and the clamping or unclamping of at least one conductor between the clamping piece and the contact piece following rotation of the screw, and means for retaining the screw-clamp assembly in the fully open position of the terminal.

2. Description of the Prior Art

Terminals or terminal strips thus formed are well known. It is in fact often required to be able to retain the screw-clamp assemblies in the unscrewed position of the screws so as to be able to deliver the electric appliances equipped with such terminals with the "terminals unclamped".

Furthermore, it is often required to protect the user of an electric appliance from direct contact with the live parts of the terminals of the appliance by means of a removable protective cap such as described in U.S. Pat. No. 4,531,797.

There is then a contradiction between the fact of hiding the live parts of the terminals when the removable cap is present and the desire sometimes expressed by the user of making these terminals more visible and more accessible for checking by removing the removable cap. In fact, the cap is provided with means bearing on the clamps for retaining the screws, so that removal of the cap means that the screw-clamp assemblies are no longer held.

The purpose of the invention is in particular to overcome this drawback in screw terminals or terminal strips provided with clamping pieces which cannot be lost by maintaining these latter efficiently in position, not only in the absence but also in the presence of a cap for protecting against direct contact, while allowing ready fitting of the screw-clamp assemblies in the terminal body or terminal strip body.

SUMMARY OF THE INVENTION

In accordance with the invention, in a screw connection device of the above type, the means for retaining the screw-clamp assembly are formed by a structure integral with the insulating body, partially surrounding the screw head and having at least one heel applicable against an inclined face of the clamp and adapted so as to hold the screw-clamp assembly in position against removal along the axis of the screw and against tipping towards the side at which the conductor is inserted.

Since the retaining structure integral with the terminal body only partially envelopes the screw head, fitting of the terminal is thereby facilitated, such fitting being achieved either by placing one part of the body with the retention structure on the screw-clamp assembly already laid on the contact piece, or by laterally inserting the screw-clamp contact piece subassembly into the terminal body.

Thus, in a first embodiment the screw-clamp assembly is fixed on the contact piece so as to form a sub-assembly which is inserted and locked in the insulating body by means of projections and complementary notches provided on the contact piece and the body; insertion of the sub-assembly determines the engagement of the clamp under the structure integral with the body.

In a second embodiment, the screw-clamp assembly is fitted on the contact piece which is itself housed in a first part of the insulating body; the retention structure integral with the body is then added in the form of a second part of the insulating body which is positioned and fixed on the first part. The two parts of the insulating body are adapted so as to form, after mutual fixing thereof and between adjacent terminals, partitioning which ensures leak lines of sufficient length. The second part of the insulating body may advantageously be formed by a stationary part of a removable protective cap, this part being provided with elements for fixing on the first part of the body, whereas the rest of the cap is separable—for example by cutting—with respect to the stationary part.

Preferably, when a removable protective cap is fixed to the insulating body, this cap has a shape circularly surrounding the screw head partially and complementarily to the retention structure integral with the body. The result is a lesser risk of catching the tool for rotating the screw on sharp edges of the retention structure.

The device of the invention is applicable to terminals or terminal strips associated with or integrated in low voltage electric applicances such as contractors, relays, programmable automata and similar apparatus.

BRIEF DESCRIPTION OF THE DRAWINGS

The description of non limitative embodiments which follows with reference to the accompanying drawings will better show the characteristics and advantages of the invention.

DESCRIPTION OF THE PREFERRED EMBODMENTS

Figure 1:
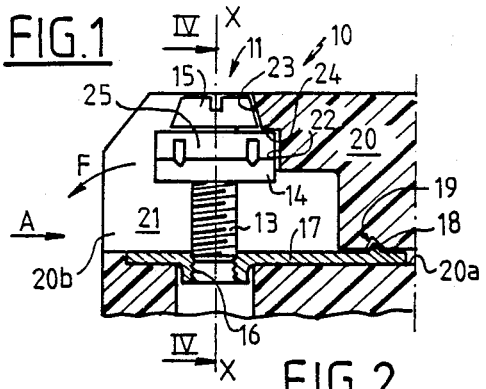
FIG. 1 shows in partial section a low voltage electric apparatus fitted with a connection device of the invention.
Figure 4:
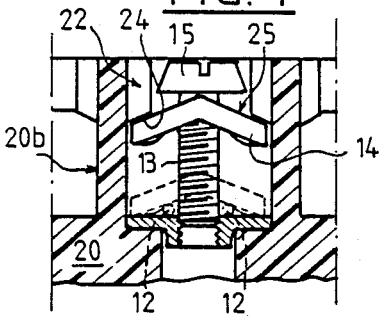
FIGS. 4 and 5 show the section IV-IV and the front view through V—V of the apparatus of FIGS. 1 and 2.
Figure 5:
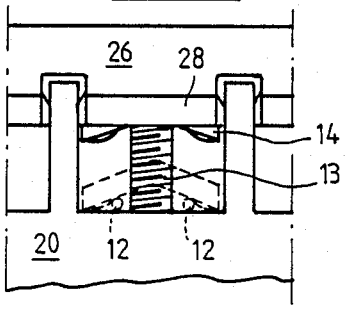

The low voltage electric apparatus 10 shown in FIG. 1 is for example a contactor and it has several terminals 11 each provided for the connection of one or two power conductors 12 (see FIGS. 4 and 5). Each terminal 11 includes an assembly formed of a screw 13 and a V shaped clamping piece 14 mounted so as not to be lost under the head 15 thereof, with mutual freedom of rotation.

Screw 13 is fitted on a tapped bore 16 formed in a contact piece 17 which is provided with projections 18 cooperating with notches 19 formed in the insulating body 20 of the apparatus. For separating the terminals, body 20 has dividing walls 20*b* and for each screw-clamp assembly a housing 21 whose walls cooperate with the clamp so as to secure it against rotation while allowing it to move in translation following rotation of the screw. In order to clamp or unclamp at least one conductor end, the unclamped position of the screw-clamp assembly is shown with continuous lines and the clamped position with broken lines in FIGS. 4 and 5.

Figure 3:
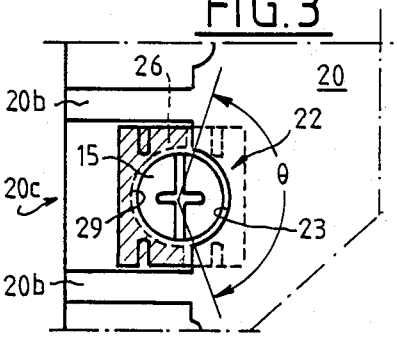
FIG. 3 is a top view of one of the terminals of the device of FIG. 1.

According to the invention, a structure 22 is provided about the head 15 of the screw, over a part of the circumference thereof, along a circular sector with an opening (see FIG. 3), so as to envelope the screw head by a substantially cylindrical shaped wall 23 and to cover, by means of heels or inclined faces 24 of structure 22 and provided on the underface thereof, the upper slanting surfaces 25 of the V shaped clamp 14. Structure 22 forms as it were a gripping projection on the insulating body which ensures maintenance of the screw-clamping piece assembly against removal along the axis X—X of the screw and against tipping towards the insertion side of the conductors (arrow F FIG. 1). It may be noted that the structure 22 covers clamp 14 bilaterally on the side thereof which is opposite the opening 20*c* for insertion of the conductor.

Figure 2:
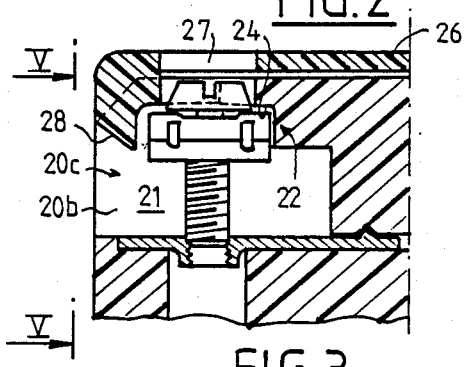
FIG. 2 is a similar view of the same apparatus with the addition of a protective cap on the terminals.

An insulating protective cap 26 may be removably fitted on the insulating body of the apparatus (see FIGS. 2 and 4) by being fixed thereto by means of interfitting, snap fit or clipping elements, not shown. Cap 26 covers several terminals and for each terminal has an access opening 27 for a screw driver or other tool for actuating screw 13, as well as a guide ramp 28 for the conductors to be inserted.

It should be noted that the cap does not need to have a specific surface for retaining the clamping piece 14, this function being already provided by the heels 24 of the structure 22 integral with the body. Cap 26 on the other hand has a cylindrical shape 29 which circularly surrounds each screw head 15 partially and complementarily to the cylindrical wall 23 of the retention structure 22 (see FIG. 3).

Figure 6:
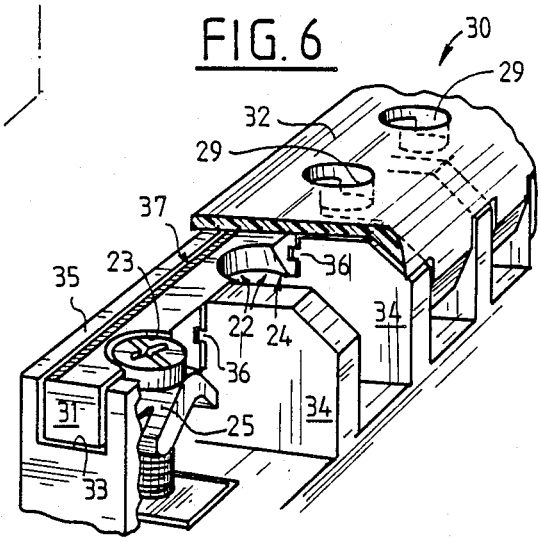
FIG. 6 is a perspective view of a variant of construction of the device of the invention.
Figure 7:
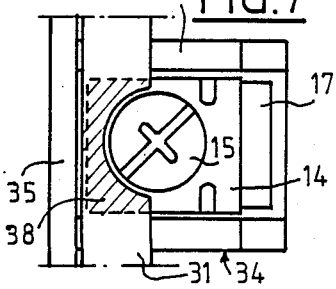
FIG. 7 is a top view of one terminal of the device of FIG. 6.

In the terminal strip variant of the invention illustrated in FIGS. 6 and 7, the removable protective cap assembly 30 is formed of a separable stationary element 31 and a removable cap 32 properly speaking. Part 31 can be fitted into notches 33 in the dividing walls 34 of the insulating body 20 of the apparatus. Part 31 is applied against a rear wall 35 of the body and remains attached in notches 33 by clipping or snap fit elements 36. Part 31 is in the form of a bar with retention structures 22 for the screw-clamp assemblies and it is connected to cap 32 by separable weakened zones 37 or other similar elements allowing the cap to be removed after the first positioning of the cap assembly 30. The terminal strip is shown in FIG. 6 with a single screw-clamp assembly and such an assembly is shown in a plane view in FIG. 7, where the retention zone 38 provided by the gripping projection of heels 24 is hatched.

Fitting of the screw-clamp assemblies and covering them by means of the respective retention structures 22 is particularly easy. In the embodiment shown in FIGS. 1 to 5, the screw 13-clamping piece 14-contact piece 17 assembly is slid in direction A into the slit 20*a* of body 20 until the projections 18 stop in notches 19, whereas the slanting surfaces 25 of the clamping piece 14 are engaged under the heels 24 of structure 22 and the screw head 15 is engaged in the cylindrical wall 23 of structure 22 with, if required, slight resilient engagement of this head by the gripping projection. Cap 25 may then be fitted or not as the user desires.

In the embodiment shown in FIGS. 6 and 7, with the screw 13- clamping piece 14 assemblies placed on their respective contact pieces 17, the cap assembly 30 is placed on the insulating body 20, the bar 31 penetrates into notches 33 and remains locked by the engagement elements 36. If the user desires to remove the cap, he simply removes the separable zones 37 and the screw-clamping piece assemblies are held in position by the heels 24 provided on bar 31.

What is claimed is

1. A connection device for electric conductors, having at least one terminal which includes:
   - a clamping screw which may be screwed into a tapped orifice of a contact piece, said screw having a head;
   - a clamping piece mounted so as not to be lost under the screw head;
   - an insulating body with an access opening for a tool for actuating the screw head and a housing for the screw-clamp assembly, the walls of this housing cooperating with the clamping piece so as to permit a translational movement thereof and the clamping or unclamping of at least one conductor between the clamping piece and a contact piece following rotation of the screw;
   - means for retaining the screw-clamp assembly in the fully open position of the terminal, wherein
   - the means for retaining the screw-clamp assembly are formed by a gripping projection of the insulating body, partially surrounding the screw head and having at least one heel applicable against an inclined face of the clamp and adapted so as to hold the screw-clamp assembly in position against removal along the axis of the screw and against tipping towards the side of the conductor.

2. The device as claimed in claim 1 wherein an insulating cap for protection against direct contact of the terminals by a user is removably fitted on the insulating body, the cap having an access opening for the tool and a ramp for guiding the conductor.

3. The device as claimed in claim 2 wherein said cap has a shape circularly surrounding each screw head partially and complementarily to said gripping projection.

4. The device as claimed in claim 3 wherein said insulating body is provided on a part of the cap serving for fixing it to the terminal body, said cap part being detachable therefrom and remaining integrally attached to the terminal body when the cap is removed from said part.

* * * * *